US010669706B2

(12) United States Patent
Phonethepswath et al.

(10) Patent No.: US 10,669,706 B2
(45) Date of Patent: Jun. 2, 2020

(54) TOILET ASSEMBLIES

(71) Applicant: 3S Renovations, LLC, Rochester, NY (US)

(72) Inventors: Souksavanh Phonethepswath, Rochester, NY (US); Sakon Sinthone Phonethepswath, Rochester, NY (US)

(73) Assignee: 3S Renovations, LLC, Rochester, NY (US)

( * ) Notice: Subject to any disclaimer, the term of this patent is extended or adjusted under 35 U.S.C. 154(b) by 0 days.

(21) Appl. No.: 15/958,077

(22) Filed: Apr. 20, 2018

(65) Prior Publication Data

US 2019/0323221 A1 Oct. 24, 2019

(51) Int. Cl.
*E03D 9/05* (2006.01)

(52) U.S. Cl.
CPC ..... *E03D 9/05* (2013.01)

(58) Field of Classification Search
CPC ..... E03D 9/05
USPC ..... 4/213
See application file for complete search history.

(56) References Cited

U.S. PATENT DOCUMENTS 3,733,619 A 5/1973 Smith
3,805,304 A 4/1974 Ikehata
3,869,737 A 3/1975 Stevenson
3,913,150 A * 10/1975 Poister ..... E03D 9/052 4/213
3,999,225 A 12/1976 Ables
4,044,406 A 8/1977 Hargraves
4,148,103 A 4/1979 Nishioka
4,165,544 A 8/1979 Barry
4,174,545 A 11/1979 Smith, Jr.
4,200,940 A 5/1980 Buchanan
4,318,192 A 3/1982 Williams et al.
4,494,255 A 1/1985 Drummond
4,627,116 A 12/1986 Shimizu
4,701,966 A 10/1987 Schafer
4,787,103 A 11/1988 Endo
4,853,982 A 8/1989 Martinval
4,975,990 A 12/1990 Chan
4,989,276 A 2/1991 Martens
5,005,222 A 4/1991 Sim
5,054,131 A 10/1991 Sim
5,058,217 A 10/1991 Taguchi et al.
5,068,926 A 12/1991 Suzuki
5,079,782 A 1/1992 Sim
5,167,039 A 12/1992 Sim
5,353,443 A 10/1994 Sim
5,369,813 A 12/1994 Goddard et al.
5,388,280 A 2/1995 Sim
5,539,937 A 7/1996 Barefoot
5,715,543 A 2/1998 Sim
5,829,066 A 11/1998 Aibe
6,000,070 A 12/1999 Bonin
6,019,862 A 2/2000 Cardwell et al.
(Continued)

*Primary Examiner* — Lori L Baker
(74) *Attorney, Agent, or Firm* — Woods Oviatt Gilman LLP; Katherine H. McGuire, Esq.

(57) ABSTRACT

A floor standing and wall mountable toilet assemblies having one or more auxiliary features including an odorous air pathway to remove odors from the toilet bowl and deliver them to the waste outlet, a foot stool movable between a stored position with the toilet bowl base and an extended in-use position in front of the toilet bowl, and a toilet roll holder attached to the bowl.

11 Claims, 6 Drawing Sheets

(56) References Cited

U.S. PATENT DOCUMENTS 6,158,058 A 12/2000 Martens
6,219,853 B1 4/2001 Johnson
6,233,749 B1 5/2001 Sasaki et al.
6,260,214 B1 7/2001 Smith
6,332,229 B1 12/2001 O'Malley et al.
6,499,150 B1 12/2002 Thompson
6,745,417 B2 6/2004 Sumino
6,804,837 B1 * 10/2004 Guess, Sr. ..... E03D 9/052 4/213
6,959,459 B2 11/2005 Takenaga
7,096,518 B2 8/2006 Takenaga
7,322,055 B2 1/2008 Takenaga
7,614,092 B1 11/2009 Turkman
7,797,766 B2 9/2010 Effinger
8,060,953 B1 11/2011 Dorra
8,112,822 B2 2/2012 Yoo
8,776,278 B1 7/2014 Dorra
9,499,966 B2 * 11/2016 Darnell ..... E03D 9/05
9,845,593 B2 12/2017 Hall et al.
2003/0014809 A1 1/2003 Thompson
2003/0074731 A1 4/2003 Sumino
2004/0205882 A1 * 10/2004 Mundt ..... E03D 9/05 4/213
2005/0000006 A1 1/2005 Takenaga
2005/0108816 A1 5/2005 Takenaga
2006/0230509 A1 10/2006 Takenaga
2007/0256219 A1 11/2007 Ellinger
2009/0126089 A1 * 5/2009 Smith ..... E03D 9/05 4/213
2010/0242161 A1 9/2010 Yoo
2011/0047686 A1 3/2011 Moore
2015/0292189 A1 10/2015 Chavez
2016/0040415 A1 2/2016 Wafford
2017/0107709 A1 4/2017 Kausch et al.
2017/0121955 A1 5/2017 Hall et al.
2018/0020889 A1 * 1/2018 Hall ..... A47K 17/02 4/300
2018/0073234 A1 3/2018 Hall et al.
2018/0168412 A1 * 6/2018 Pham ..... A47K 17/028
2018/0303466 A1 * 10/2018 Kashyap ..... A61B 10/0038
2019/0063054 A1 * 2/2019 Luettgen ..... A47K 17/00

* cited by examiner

TOILET ASSEMBLIES

FIELD OF THE INVENTION

The present invention generally relates to toilets and more particularly relates to toilets with one or more useful auxiliary features.

BACKGROUND OF THE INVENTION

Modern day toilet designs basically include a bowl having a water inlet and a water outlet leading to a sewer pipe. While many alternate toilet designs have been proposed in the past, there remains room for improvement, particularly in the nature of auxiliary features which provide added functionality to the modern day basic toilet design.

SUMMARY OF THE INVENTION

The invention provides alternate embodiments of a toilet system including several auxiliary features provided either individually or in various combinations. The auxiliary features include an odorous air venting pathway, a toilet roll holder/dispenser attached to the front of the toilet, and a stool movable between stored and in-use positions relative to the toilet base.

DESCRIPTION OF THE DRAWING FIGURES

The above-mentioned and other features and advantages of this invention, and the manner of attaining them, will become apparent and be better understood by reference to the following description of the invention in conjunction with the accompanying drawing, wherein.

DETAILED DESCRIPTION OF PREFERRED EMBODIMENTS

This document provides and describes an overview of an exemplary environment and implementation of the present invention. Reference is made respecting FIGS. 1A-13, to facilitate an understanding of the salient features and novel aspects of the invention.

Figure 1A:
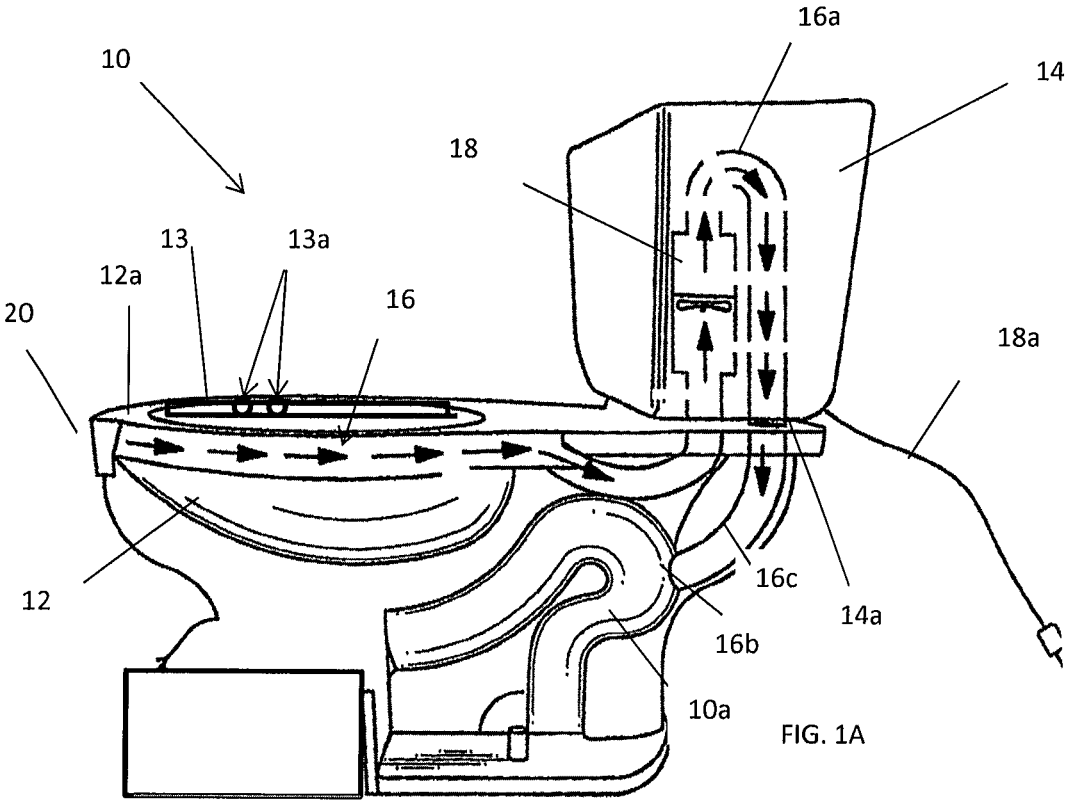
FIG. 1A is a side elevational view of one embodiment of the invention.

In the first embodiment of the present invention seen in FIG. 1A, a floor standing toilet assembly 10 is seen having a bowl 12 and a water tank 14. An auxiliary feature to reduce odors is provided in the form of a vented air pathway 16 having an inlet end and an outlet end wherein the inlet end may extend about a part of or all of the rim 12*a* of the bowl 12, leading to the interior of tank 14. The pathway may be configured as part of bowl 12 (e.g., integral to toilet bowl 12 when bowl 12 is made) or provided as an add-on feature, for example in the form of one or more spaced vent holes 13*a* which may be formed in rim 12*a* or in a separate tubing 13 attached to toilet bowl 12 adjacent rim 12*a* and wherethrough the odors may enter the pathway 16 from inside bowl 12.

Within tank 14 a looped segment 16*a* of pathway 16 directs the odorous air received from bowl 12 first upwardly and then downwardly in the tank 14, finally exiting the tank 14 at the tank bottom 14*a* and continuing along pathway segment 16*c* toward and connecting at 16*b* to the toilet outlet 10*a* which ultimately leads the toilet waste and the vented air to a waste collection point such as a sewer line (not shown). In order to facilitate the drawing of air from bowl 12 through pathway 16, a fan 18 may be provided at an appropriate point along the pathway such as to create negative pressure within pathway 16. A power source to fan 18 may be provided in the form of an electric cord and plug 18*a*. A fan switch 20 may be provided in a convenient location such as at the front of bowl 12 so that a user may selectively turn fan 18 on and off as desired.

Figure 1B:
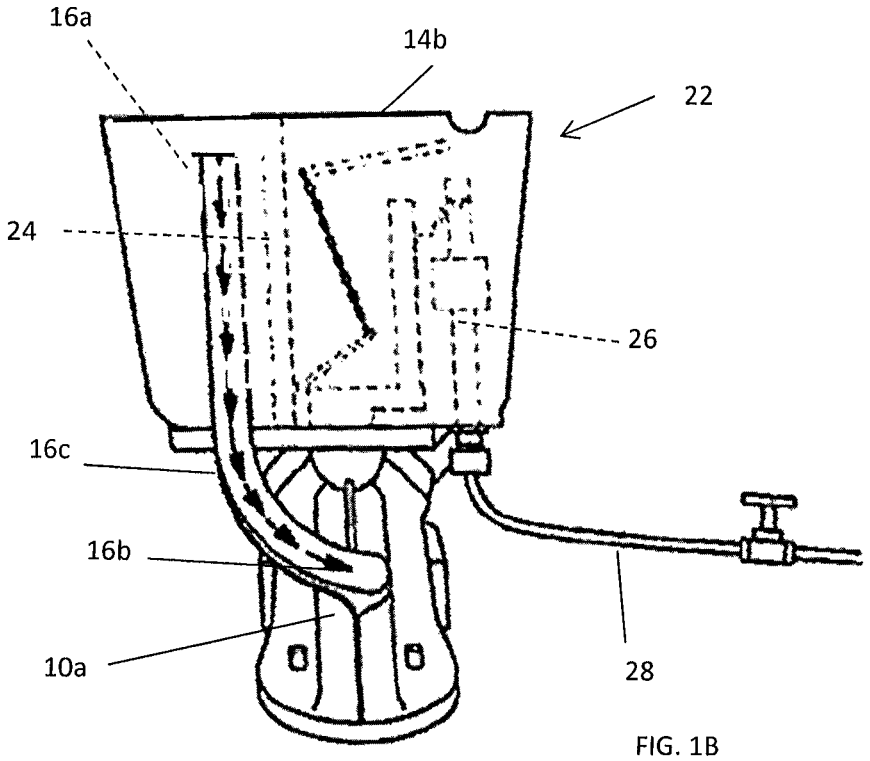
FIG. 1B is a rear elevational view of another embodiment of the invention.

FIG. 1B is a rear view of toilet assembly 22 showing the odorous air pathway 16*c* connecting at point 16*b* to the toilet outlet 10*a*. Inside tank 14 is seen a partition 24 which may be provided to hold the water on the side of the tank where the flushing assembly 26 is located. As in present day toilet assemblies, an inlet water line 28 is provided which leads through tank bottom 14*a* to feed water to tank 14 and flushing assembly 26. The opposite side of the partition 24 may be kept dry and accommodate the pathway segment 16*a* which may include fan 18.

Figure 2:
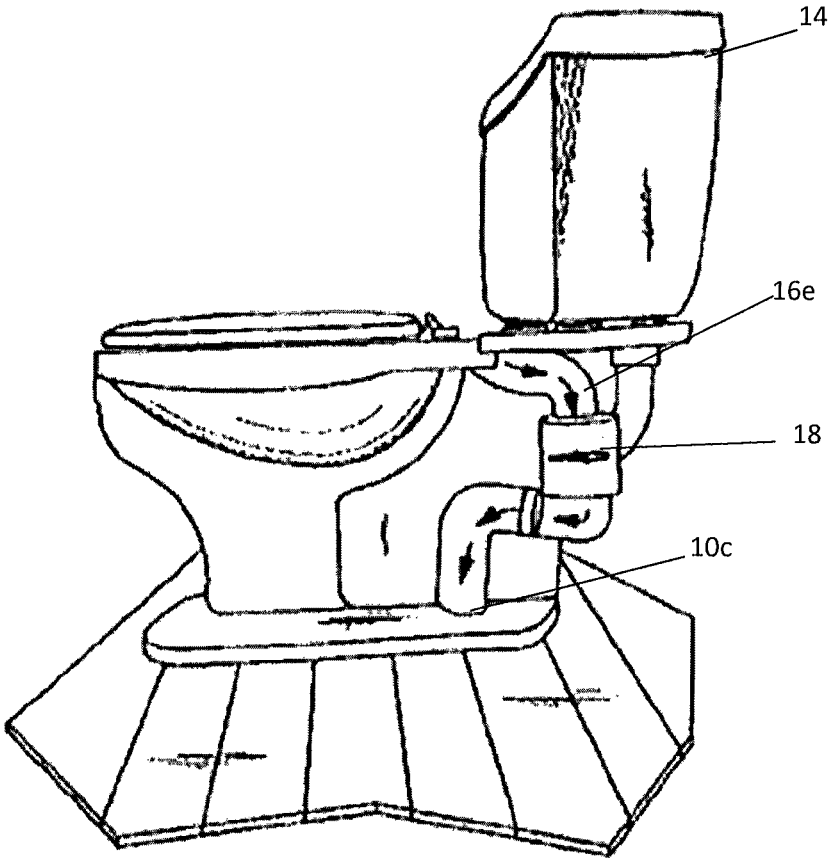
FIG. 2 is a side elevational view of another embodiment of the invention.

Referring now to FIG. 2, an alternate embodiment is seen similar to the embodiment of FIGS. 1A-B except the odorous air pathway 16*e* extends along the exterior of the toilet beneath tank 14 and ultimately feeds into the toilet outlet 10*c*.

Figure 3:
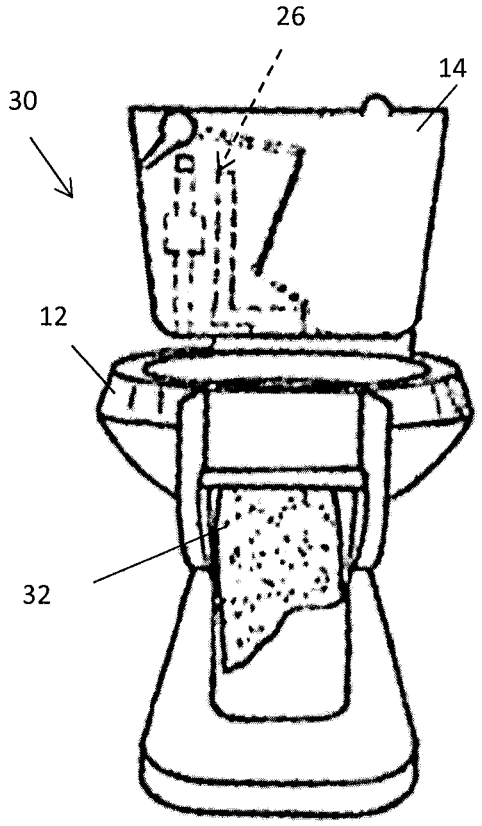
FIG. 3 is a front elevational view of another embodiment of the invention.

FIG. 3 shows a front view of another embodiment of a toilet assembly 30 wherein the auxiliary feature comprises a toilet roll holder/dispenser 32 connected to the front of the toilet bowl 12.

Figure 4:
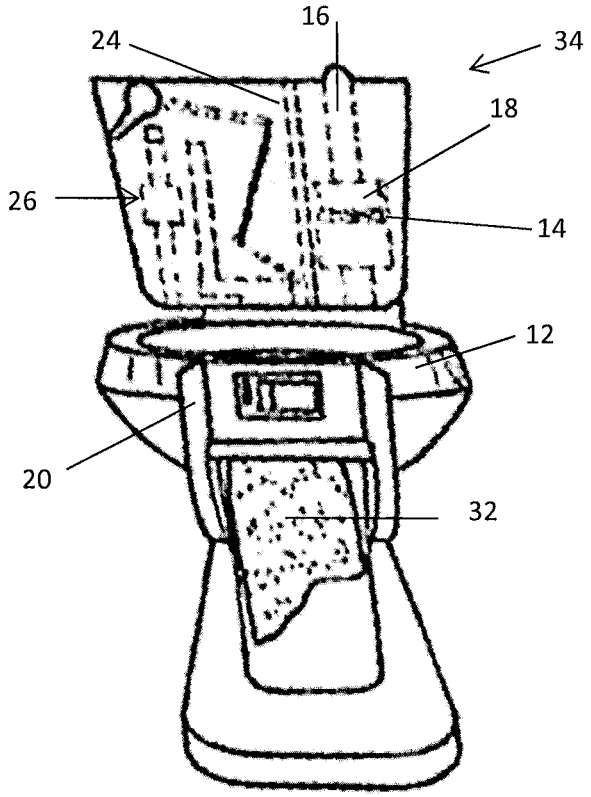
FIG. 4 is a front elevational view of another embodiment of the invention.

FIG. 4 shows a front view of another embodiment of a toilet assembly 34 wherein two of the previously described auxiliary features are provided comprising the toilet roll holder/dispenser 32 connected to the front of the toilet bowl 12, and the odorous air pathway 16 with fan 18 located inside tank 14 in the manner described above. Although the odorous air pathway 16 is seen inside the tank, it is understood that it may alternately be provided in this embodiment outside the tank 14 as seen in FIG. 2, as desired.

Figure 5:
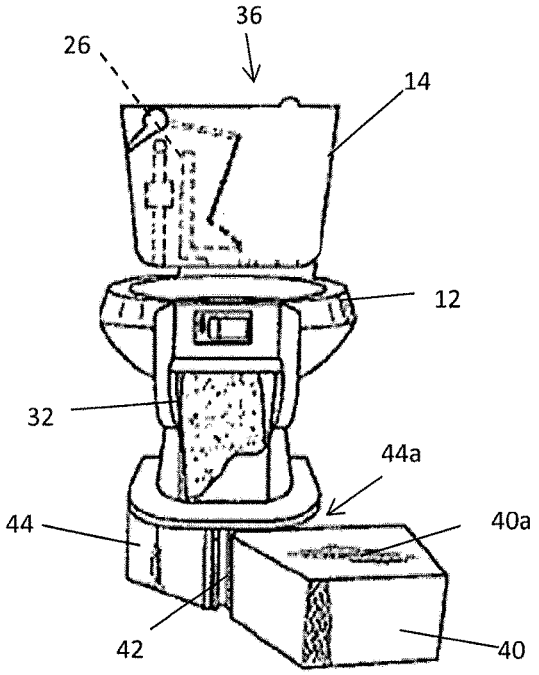
FIG. 5 is a front elevational view of another embodiment of the invention.

FIG. 5 shows a front view of another embodiment of a toilet assembly 36 wherein one of the previously described auxiliary features is provided comprising the toilet roll holder/dispenser 32 connected to the front of the toilet bowl 12, as well as another auxiliary feature comprising a foot stool 40. The foot stool 40 may be connected via a hinge 42 to base 44 which provides a storage area for the stool when not in use. More particularly, when not in use, the stool 40 may reside within an open area 44*a* of the base 44. When it is desired to use the stool 40, the user simply pulls the stool outwardly until it comes to rest in front of bowl 12 where the user may then place and rest their feet on the top surface 40*a* of stool 40.

Figure 6:
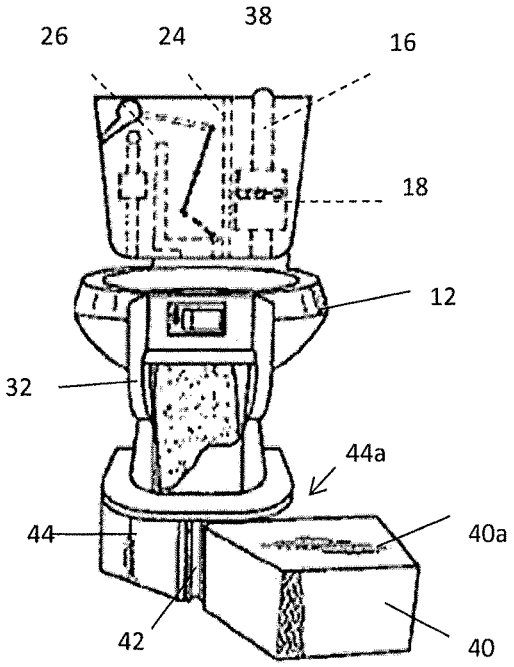
FIG. 6 is a front elevational view of another embodiment of the invention.

FIG. 6 shows another embodiment of a toilet assembly 38 which is the embodiment of FIG. 5 except the embodiment of FIG. 6 further includes the odorous air pathway 16 and fan 18. Although the odorous air pathway 16 is seen inside the tank, it is understood that it may alternately be provided in this embodiment outside the tank 14 as seen in FIG. 2, as desired.

Figure 7:
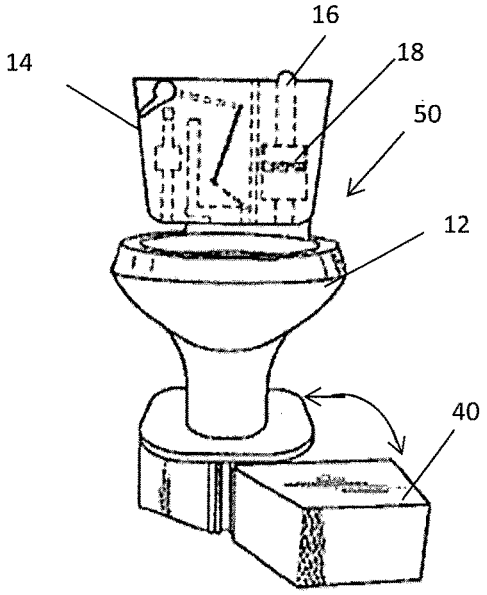
FIG. 7 is a front elevational view of another embodiment of the invention.

FIG. 7 shows an embodiment of a toilet assembly 50 which is the embodiment of FIG. 6 except without the toilet roll holder/dispenser.

Figure 8:
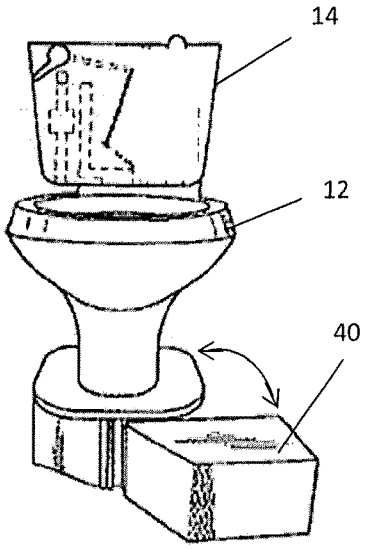
FIG. 8 is a front elevational view of another embodiment of the invention.

FIG. 8 is the embodiment of FIG. 7 except without the odorous air pathway 16 and fan 18.

Figure 9:
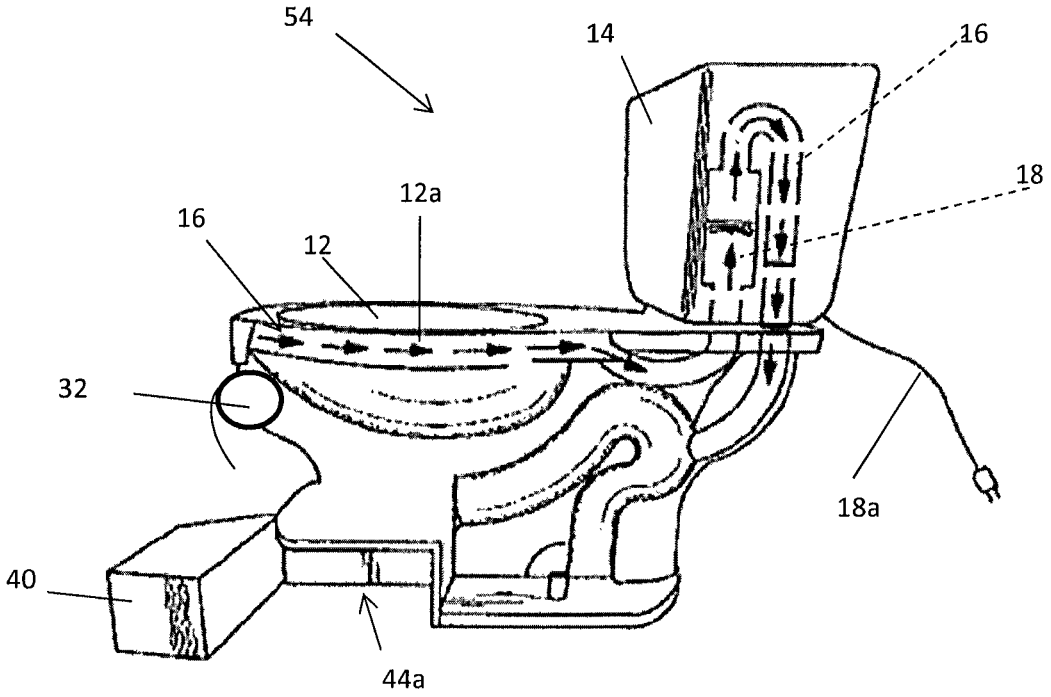
FIG. 9 is a side elevational view of another embodiment of the invention.

FIG. 9 is another embodiment of toilet assembly 54 having all auxiliary features including the odorous pathway 16, fan 18, stool 40 and toilet roll holder/dispenser 32. In this embodiment, the pathway 16 and fan 18 are inside the tank 14.

Figure 10:
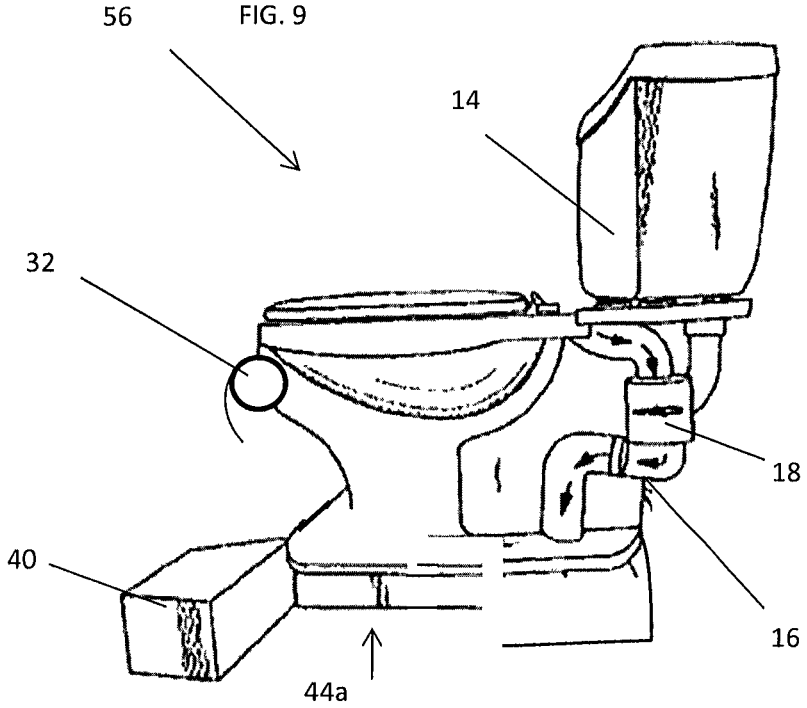
FIG. 10 is a side elevational view of another embodiment of the invention.

FIG. 10 is another embodiment of toilet assembly 56 having all auxiliary features including the odorous pathway 16, fan 18, stool 40 and toilet roll holder/dispenser 32. In this embodiment, the pathway 16 and fan 18 are outside the tank 14.

Figure 11:
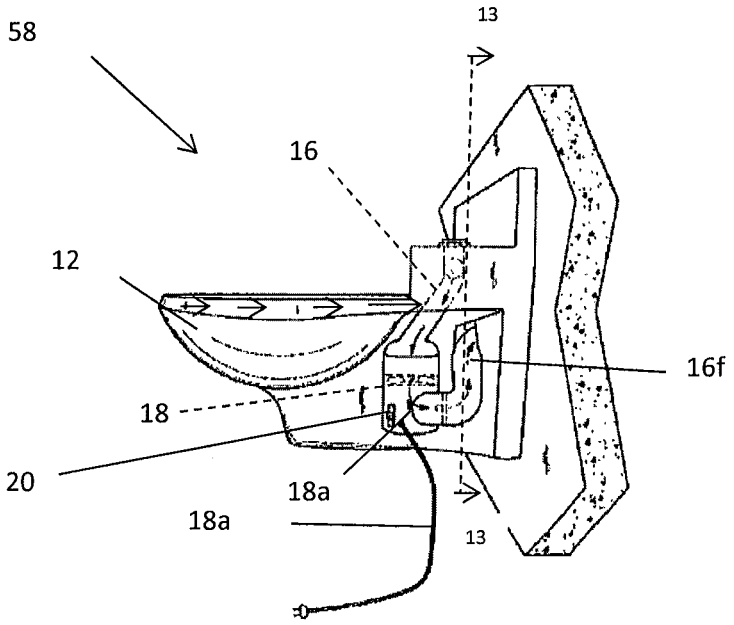
FIG. 11 is a side elevational view of an alternate embodiment of the invention.
Figure 12:
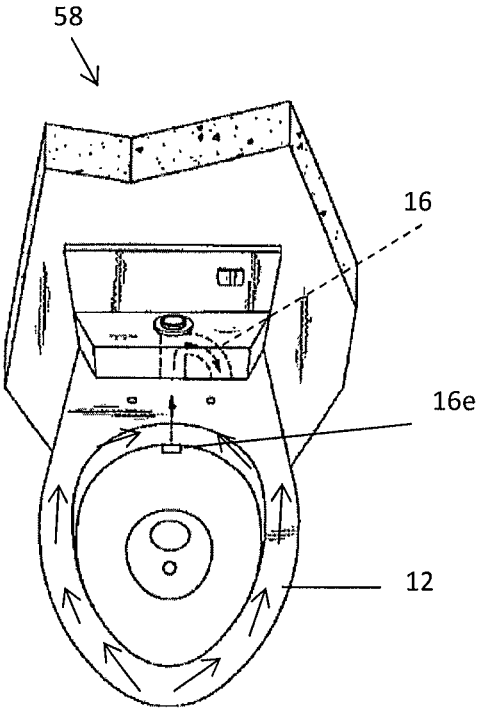
FIG. 12 is a top plan view of the embodiment of FIG. 11.
Figure 13:
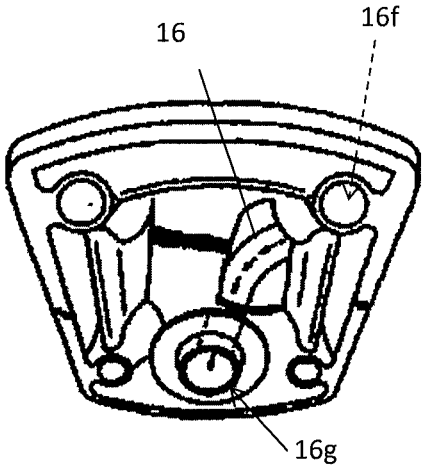
FIG. 13 is a cross sectional view taken along the line 13-13 in FIG. 11 showing the pathway from the vent to the sewer outlet.

FIGS. 11-13 show a commercial wall mountable type of toilet assembly 58 having odorous air pathway 16 and fan 18 with electric cord 18*a*. In this embodiment, the odorous air pathway inlet 16*e* is located adjacent the back of bowl 12. The air pathway outlet 16*f* is directed into the wall and directed into the waste outlet 16*g*. A switch 20 may be provided allowing the user to selectively turn the fan 18 on and off. A one way valve 18*a* may be provided adjacent fan 18 to ensure odorous gases cannot travel in the reverse back toward bowl 12.

While the invention has been shown and described with reference to certain preferred embodiments thereof, it will be understood by those skilled in the art that various changes in form and details may be made therein without departing from the spirit and scope of the invention as described.

What is claimed is:

1. A toilet assembly having a toilet bowl with a toilet bowl rim and a liquid outlet connected to a waste outlet, said toilet assembly comprising:

a) an odorous air pathway having an inlet and an outlet, said odorous air pathway inlet located inside said toilet bowl and extending along said toilet bowl rim, said odorous air pathway outlet connected to said waste outlet wherein said toilet assembly further includes a tank having a flushing assembly located therein and fluidly connected to said toilet bowl, and wherein at least a portion of said odorous air pathway extends within said tank, wherein said toilet assembly further includes a partition inside said tank and dividing the interior of said tank into a wet side and a dry side, said wet side including said flushing assembly located therein and said dry side including said odorous air pathway located therein.

2. The toilet assembly of claim 1 wherein said toilet assembly further includes a tank having a flushing assembly located therein and fluidly connected to said toilet bowl, and wherein all of said odorous fluid pathway is located exteriorly of said tank.

3. The toilet assembly of claim 1 and further comprising a fan connected to said odorous air pathway, said fan operable to draw from said odorous air pathway inlet to said odorous air pathway outlet.

4. The toilet assembly of claim 3 wherein said fan includes an on-off switch.

5. The toilet assembly of claim 1 wherein said toilet bowl is attached to a toilet base having an open area, and further comprising a foot stool connected to said base and movable between a stored position wherein said stool in located with said open area of said base, and an in-use deployed position wherein said stool is moved out from said base open area and locates adjacent said toilet bowl.

6. The toilet assembly of claim 5 wherein said foot stool is connected to said toilet base by a hinge.

7. The toilet assembly of claim 1 and further comprising a toilet roll holder attached to said toilet bowl rim.

8. The toilet assembly of claim 1 wherein said toilet bowl is wall mountable.

9. The wall mountable toilet assembly of claim 8 and further comprising a fan switchable between on and off positions, said fan operable to draw air from said odorous air pathway inlet to said odorous air pathway outlet.

10. The toilet assembly of claim 1 and further wherein said odorous air pathway inlet is formed as an integral part of said toilet bowl rim.

11. The toilet assembly of claim 1 and wherein said odorous air pathway includes a tubing having one or more vent holes attached to said toilet bowl adjacent said toilet bowl rim.

* * * * *